US010112743B2

(12) United States Patent
Beardsall

(10) Patent No.: US 10,112,743 B2
(45) Date of Patent: Oct. 30, 2018

(54) CONTAINER HAVING A BASE AND A LID

(71) Applicant: SWEDISH MATCH NORTH EUROPE AB, Stockholm (SE)

(72) Inventor: Philip Beardsall, Örkelljunga (SE)

(73) Assignee: Swedish Match North Europe AB, Stockholm (SE)

( * ) Notice: Subject to any disclaimer, the term of this patent is extended or adjusted under 35 U.S.C. 154(b) by 407 days.

(21) Appl. No.: 14/758,932

(22) PCT Filed: Feb. 11, 2014

(86) PCT No.: PCT/EP2014/052653

§ 371 (c)(1),
(2) Date: Jul. 1, 2015

(87) PCT Pub. No.: WO2014/124939

PCT Pub. Date: Aug. 21, 2014

(65) Prior Publication Data

US 2016/0368670 A1 Dec. 22, 2016

Related U.S. Application Data

(60) Provisional application No. 61/763,976, filed on Feb. 13, 2013.

(30) Foreign Application Priority Data

Feb. 13, 2013 (EP) ..... 13155026

(51) Int. Cl.
*B65D 43/02* (2006.01)
*B65D 51/28* (2006.01)
*A24F 23/00* (2006.01)

(52) U.S. Cl.
CPC ..... *B65D 43/0212* (2013.01); *A24F 23/00* (2013.01); *B65D 51/28* (2013.01);
(Continued)

(58) Field of Classification Search
CPC ..... B65D 51/28; B65D 2209/00; B65D 2543/00092; B65D 2543/296;
(Continued)

(56) References Cited

U.S. PATENT DOCUMENTS 3,995,766 A * 12/1976 Fralick ..... B65D 21/0222 220/282
2009/0008391 A1* 1/2009 Bjorkholm ..... A24F 23/00 220/315
2012/0205375 A1 8/2012 Hudson et al.

FOREIGN PATENT DOCUMENTS

DE 7218950 9/1972
WO WO 2011/001284 1/2011

OTHER PUBLICATIONS

Aug. 5, 2014 International Search Report for Int'l. App. No. PCT/EP2014/052653 (3 pgs).

* cited by examiner

*Primary Examiner* — J. Gregory Pickett
*Assistant Examiner* — Elizabeth Volz
(74) *Attorney, Agent, or Firm* — Knobbe Martens Olson & Bear LLP

(57) ABSTRACT

The disclosure concerns a container (1) having a base (2) and a lid (3), wherein the lid (3) comprises a first plurality of abutment projections (4) positioned circumferentially spaced apart on an inside of the lid (3) and configured to contact an upwardly facing abutment surface (5) of a side wall (6) of the base (2) when the base (2) and lid (3) are arranged parallel to each other and pressed together to form a closed container. The lid (3) further comprises a second plurality of abutment projections (7) positioned circumferentially spaced apart on an inside of the lid (3) and configured to contact an upwardly facing abutment surface (5) of a side wall (6) of the base (2) when the base (2) and the lid
(Continued)

(3) are arranged inclined to each other and pressed together. The disclosure concerns a container (1) having a base (2) and a lid (3), wherein the lid (3) comprises an upper wall (12) and at least two depressions (22) positioned spaced apart along the circumference of the upper wall (12).

17 Claims, 13 Drawing Sheets

(52) U.S. Cl.
CPC ..... *B65D 2209/00* (2013.01); *B65D 2543/00092* (2013.01); *B65D 2543/00296* (2013.01); *B65D 2543/00509* (2013.01); *B65D 2543/00527* (2013.01); *B65D 2543/00537* (2013.01); *B65D 2543/00555* (2013.01); *B65D 2543/00629* (2013.01); *B65D 2543/00685* (2013.01); *B65D 2543/00731* (2013.01); *B65D 2543/00796* (2013.01)

(58) Field of Classification Search
CPC ..... B65D 2543/00509; B65D 2543/00527; B65D 2543/00537; B65D 2543/00555; B65D 2543/00629; B65D 2543/00685; B65D 2543/00731; B65D 2543/00796; B65D 2543/0296; B65D 2543/00796; A24F 23/00
USPC ..... 220/521, 282, 782, 792, 796, 799, 315; 215/343
See application file for complete search history.

CONTAINER HAVING A BASE AND A LID

CROSS REFERENCE TO RELATED APPLICATIONS

This application is a U.S. National Phase Application of PCT International Application Number PCT/EP2014/052653, filed on Feb. 11, 2014, designating the United States of America and published in the English language, which is an International Application of and claims the benefit of priority to European Patent Application No. 13155026.1, filed on Feb. 13, 2013, and U.S. Provisional Application No. 61/763,976, filed on Feb. 13, 2013. The disclosures of the above-referenced applications are hereby expressly incorporated by reference in their entireties.

TECHNICAL FIELD

This disclosure relates to a container having a base and a lid.

BACKGROUND OF THE DISCLOSURE

Containers having a base and a lid are commonly used for storing tobacco products. Such containers and in particular the lids thereof are often made of plastic material and commonly produced by injection moulding. The lid may contain ribs acting as abutments for the side wall of the base when the container is closed.

DE 7218950 U discloses a lid having a guiding cone intended to be inserted into a receptacle and a supporting wall arranged at a distance from the guiding cone for supporting the lid on the rim of the receptacle. Between the guiding cone and the supporting wall are radially extending strengthening ribs arranged at a distance from each other.

A problem with this prior art solution is that an uneven colouring of the lid may be obtained in the region of the supporting wall of the lid.

This problem is in particular pronounced for containers having a lid where the upper edge of the lid is rounded. The rounded upper edge does not itself provide any adequate abutment for the side wall of the base of the container and projections acting as abutment for the side wall of the base when the container is closed are therefore provided.

There is thus a need for an improved container removing the above mentioned disadvantages.

SUMMARY OF THE DISCLOSURE

An object of the present disclosure is to provide an inventive container where the previously mentioned problem is at least partly avoided. This object is achieved by the features of any of the independent claims.

The disclosure concerns a container having a base and a lid, wherein the lid comprises a first plurality of abutment projections positioned circumferentially spaced apart on an inside of the lid and configured to contact an upwardly facing abutment surface of a side wall of the base when the base and lid are arranged parallel to each other and pressed together to form a closed container, and a second plurality of abutment projections positioned circumferentially spaced apart on an inside of the lid and configured to contact an upwardly facing abutment surface of a side wall of the base when the base and lid are arranged inclined to each other and pressed together.

Since the second plurality of abutment projections are positioned circumferentially spaced apart on an inside of the lid and configured to contact an upwardly facing abutment surface of a side wall of the base when the base and the lid are arranged inclined to each other and pressed together, the second plurality of abutment projections prevents the lid from attaining a position too far down on the base, i.e. overlapping the base too much, in which position the lid may be difficult pivot down to proper closed position. The second plurality of abutment projections serve to guide the lid to an appropriate position enabling easy closing of the container. Thereby, the container may be closed by pushing on top of the lid also when the lid is inclined in relation to the base. This is particularly important when the lid is positioned on top of the base and subsequently closed by a machine.

Since two pluralities of projections are present, a first plurality for abutting the base when the container is closed and a second plurality for abutting the base when the lid is inclined in relation to the lid during closing of the container, uneven colouring is avoided.

By using two pluralities of projections the flow path for the molten plastic during moulding is more limited, such that an uneven colouring of the lid is eliminated or at least reduced. If only using one projection, as in the prior art solutions, the molten plastic may during moulding flow in two different flow paths towards the exterior of the lid; one along the outer surface of the lid and one through the rib; such that two flow fronts may meet to create an uneven colouring of the lid.

The disclosure also concerns a container having a base and a lid, wherein the lid comprises at least two depressions positioned spaced apart along the circumference of an upper wall of the lid, wherein the depressions being configured such that a downwardly facing surface of said bottom of said depressions contact an upwardly facing abutment surface of a side wall of the base when the base and lid are arranged parallel to each other and pressed together to form a closed container.

The bottom of the depressions preferably extends along a plane parallel to the upper surface of the lid. The bottom of each respective depression transitions from the restriction wall (if there is a recessed area present) or from the upper wall of the lid and to the outer skirt of the lid.

The depressions in the upper wall facilitate contact between the upwardly facing abutment surface of the side wall of the base of the lid when the base and the lid are arranged inclined to each other and pressed together. Thereby, the container may be properly closed by pushing on top of the lid also when the lid is inclined in relation to the base.

By using depressions in the upper wall of the lid for aiding abutment with the base of the container the flow path for the molten plastic during moulding of the lid is more limited than using radial continuous ribs. Uneven colouring of the lid is thereby eliminated or at least reduced.

Further advantages are achieved by implementing one or several of the features of the dependent claims.

BRIEF DESCRIPTION OF DRAWINGS

In the detailed description of the disclosure given below reference is made to the following figure, in which.

DESCRIPTION OF EXAMPLE EMBODIMENTS

Figure 1A:
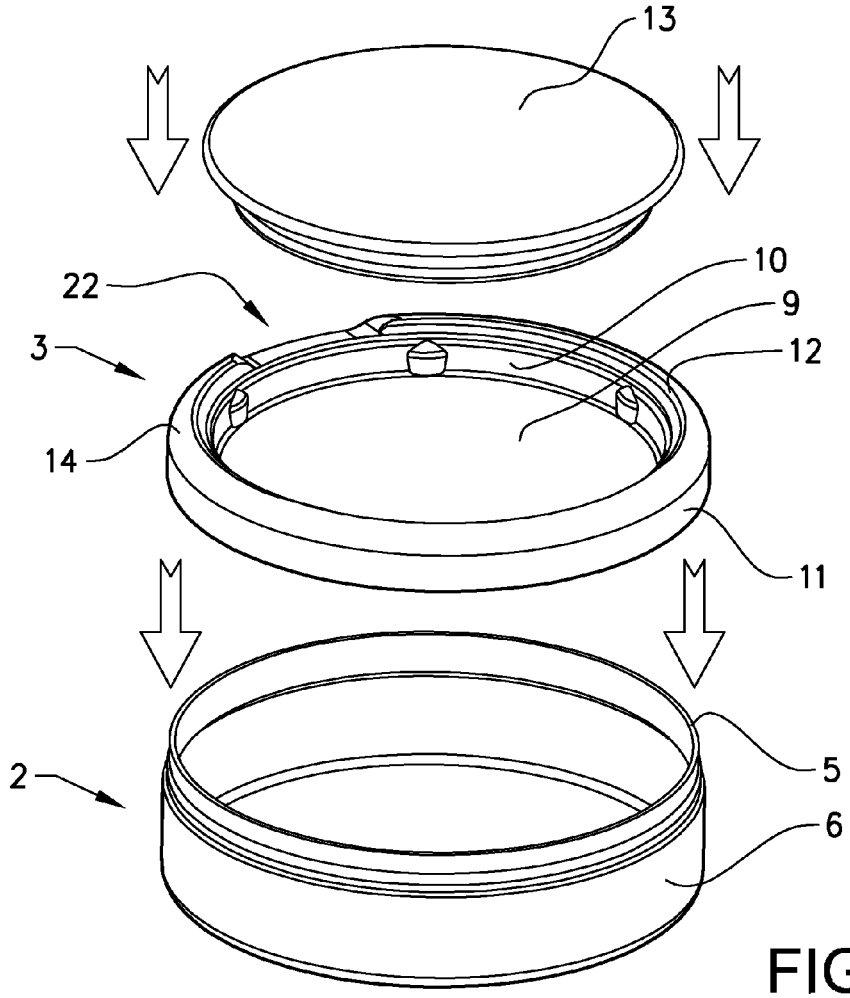
FIG. 1*a* is a perspective view of a first embodiment of a container according to the present disclosure having a base and a lid, where the container is open and the lid is placed at a distance from the base.

Various aspects of the disclosure will hereinafter be described in conjunction with the appended drawings to illustrate and not to limit the disclosure, wherein like designations denote like elements, and variations of the inventive aspects are not restricted to the specifically shown embodiments, but are applicable on other variations of the disclosure.

As described above and as shown in FIGS. 1*a*-7, the present disclosure relates to a container 1 having a base 2 and a lid 3, wherein the lid 3 comprises a first plurality of abutment projections 4 positioned circumferentially spaced apart on an inside 17 of the lid 3 and configured to contact an upwardly facing abutment surface 5 of a side wall 6 of the base 2 when the base 2 and lid 3 are arranged parallel to each other and pressed together to form a closed container 1, and a second plurality of abutment projections 7 positioned circumferentially spaced apart on an inside 17 of the lid 3 and configured to contact an upwardly facing abutment surface 5 of a side wall 6 of the base 2 when the base 2 and the lid 3 are arranged inclined to each other and pressed together. In particular it is shown in FIG. 6*b* that the first plurality of abutment projections 4 contact the upwardly facing abutment surface 5 of the side wall 6 of the base 2 when the base 2 and lid 3 are arranged parallel to each other and pressed together to form a closed container 1. Similarly it is shown in FIG. 6*a* that the second plurality of abutment projections 7 contact the upwardly facing abutment surface 5 of the side wall 6 of the base 2 when the base 2 and the lid 3 are arranged inclined to each other with an angle $\alpha$ and pressed together.

Figure 6A:
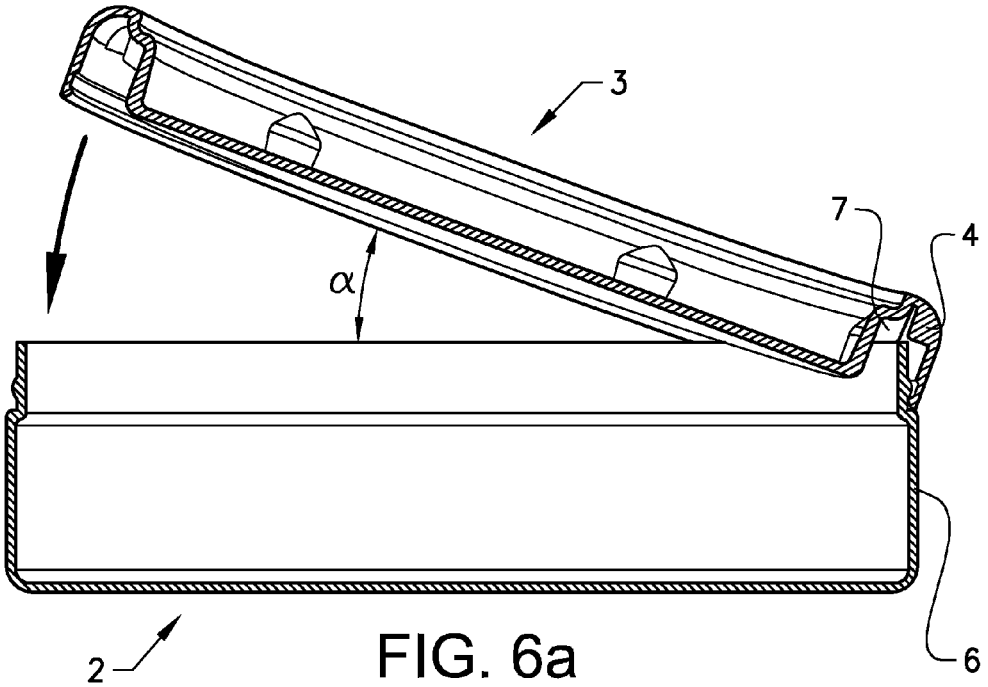
FIG. 6*a* is a side view of a container according to the present disclosure, where the lid is inclined in relation to the base.

The second plurality of abutment projections 7 enables easy closing of the container 1 by downward pushing on top of the lid 3 also when the lid 3 is inclined in relation to the base 2, as visualised in FIG. 6*a*. When the lid 3 is inclined in relation to the base 2 the second plurality of abutment projections 7 abuts the abutment surface 5 of the side wall 6 of the base 2, as is seen in FIG. 6*a*. When pushing on the lid 3 the second plurality of abutment projections 7 guides the abutment surface 5 into a position where it is in contact with the first plurality of abutment projections 4. This latter position is seen in FIG. 6*b*. The guiding of the abutment surface 5 of the base 2 accomplished by the second plurality of abutment projections 7 is important during packaging of products, such as tobacco, into the container. If the lid 3 mounted on the base in an automatic assembly process performed by one or more machines, the lid may initially be positioned on the base inclined in relation to the base 2, either by purpose or by accident. Irrespective the underlying reason, the second plurality of abutment projections 7 will upon actuation of a closing pressure on the lid guide the abutment surface 5 into a proper position enabling contact between the abutment surface 5 of the base 2 and the first plurality of abutment projections 4.

Without the second plurality of abutment projections 7, depending on the shape of the first plurality of abutment projections 4, inclination angle, etc., the lid 3 may attain a position on the base where the lid is difficult to pivot down to a parallel orientation, and thus difficult to close. This undesired position of the lid 3 is attained when the lid 3 is pushed down too far onto the side wall of the base 2, in which position a lid coupling portion 15 is vertically offset from a corresponding base coupling portion 16. When the lid 3 is too much telescoped over the base portion 2, the lid may prove difficult to close without first lifting the lid 3 a certain degree.

The guiding of the abutment surface 5 of the base 2 accomplished by the second plurality of abutment projections 7 also facilitates manual closing of the container. The second plurality of abutment projections 7 enables that one portion of the second plurality of abutment projections 7 are brought in contact with the abutment surface 5 of the base 2, whereafter a downward force is applied to the lid 3 at a location on the lid 3 substantially opposite the abutment projections of the second plurality of abutment projections 7 that are in contact with the abutment surface 5 (see FIG. 6*a*). The force may be applied at a location at the outer skirt 11 of the lid 3 opposite the region of the outer skirt 11 where the abutment projections of the second plurality of abutment projections 7 contacts the abutment surface 5 of the base 2. Thus, the container 1 may be closed by placing the lid 3 on top of the base 2 at an inclination in relation to the base 2 such that a portion of the upwardly facing abutment surface 5 of the side wall 6 of the base 2 abuts a portion of the second plurality of projections 7 and pushing at the lid 3 in the region opposite the portion of the second plurality of projections 7 abutting the portion of the abutment surface 5 of the base 2.

By having two pluralities of abutment projections 4, 7, i.e. by separating the abutment projections configured to contact the upwardly facing abutment surface 5 of the side wall 6 of the base 2 when the base 2 and lid 3 are arranged parallel to each other and pressed together to form a closed container from the abutment projections configured to contact the upwardly facing abutment surface 5 of the side wall 6 of the base 2 when the base 2 and the lid 3 are arranged inclined to each other and pressed together, it is avoided that the molten plastic flows to the outer surface of the outer skirt 11 of the lid 3 through different flow paths. In other words, it is avoided that molten plastic flows to the outer skirt 11 of the lid 3 through the first and second pluralities of abutment projections 4, 7, which could otherwise potentially occur if the first and second abutment projections 4, 7 were formed by a single abutment projection. Thereby, uneven colouring of the surface of an upper circumferential corner 14 of the lid 3 is avoided or at least reduced.

That the base 2 and the lid 3 are arranged inclined to each other means that the base 2 and the lid 3 are arranged non-parallel in relation to each other.

The second plurality of abutment projections 7 are configured to contact the upwardly facing abutment surface 5 of a side wall 6 of the base 2 when the base 2 and the lid 3 are inclined with an angle $\alpha$ in the range of 2 degrees to 45 degrees in relation to each other, preferably 5 degrees to 40 degrees in relation to each other, and more preferably 10 degrees to 35 degrees in relation to each other. These ranges are suitable for closing of the container and for guiding of the abutment surface 5 of the side wall 6 of the base 2 from contact with some of the abutment projections of the second plurality of abutment projections 7 to contact with at least some of the abutment projections of the first plurality of abutment projections.

Figure 1B:
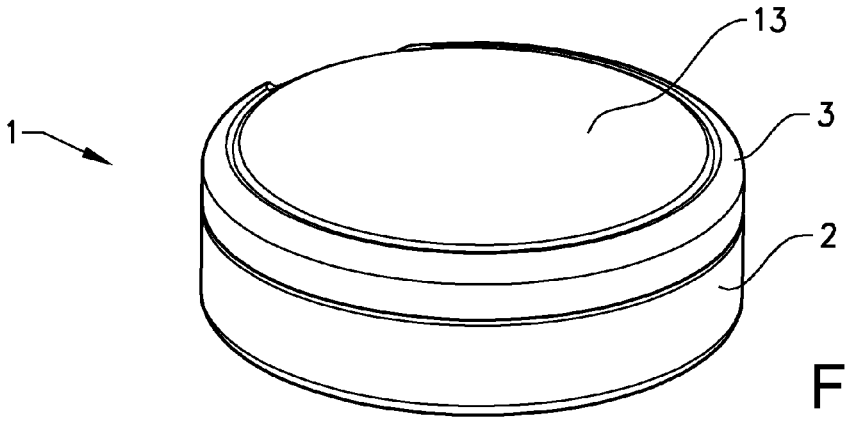
FIG. 1*b* is a perspective view of the container in FIG. 1*a*, where the container is closed.
Figure 2:
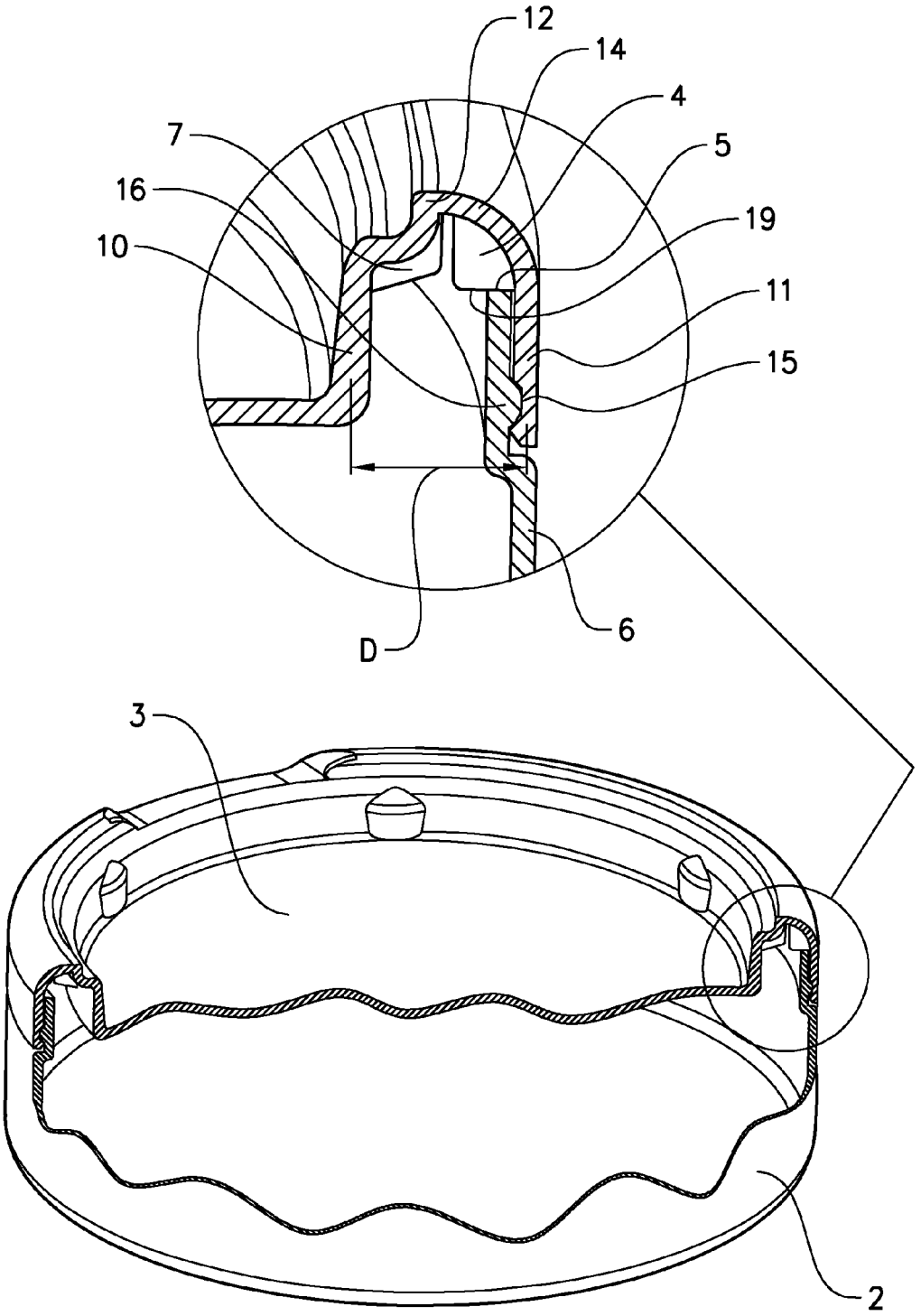
FIG. 2 is a perspective view of the container in FIGS. 1*a* and 1*b* having a cut-out and a magnified view of the region of connection between the base and the lid.
Figure 3A:
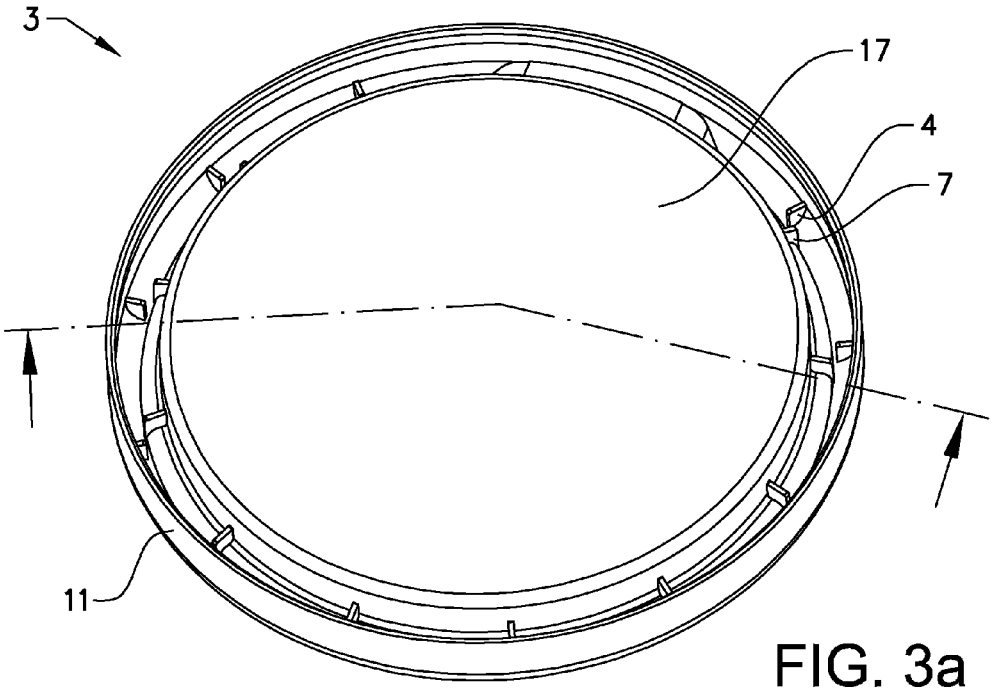
FIG. 3*a* is a perspective view of the lid shown in FIGS. 1*a*, 1*b* and 2 turned upside down.
Figure 3B:
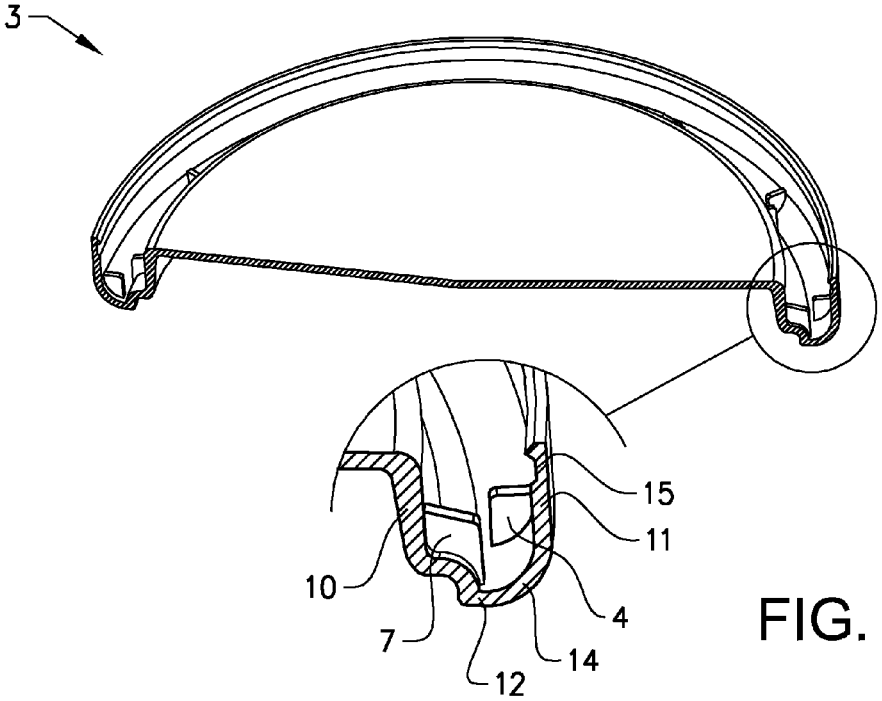
FIG. 3*b* is a perspective view of the lid in FIG. 3*a* having a cut-out and a magnified view of the region of projections.

The lid 3 comprises an outer skirt 11 configured to enclose an upper portion of the side wall 6 of the base 2 when the base 2 and the lid 3 are pressed together to form a closed container, see FIGS. 1*b*, 2 and 6*b*. Thereby, the lid 3 is arranged to enclose the abutment surface 5 of the side wall 6 of the base 2, i.e. the upper rim of the base 2.

The first plurality of abutment projections 4 are formed integrally with at least the outer skirt 11 of the lid 3, as shown in FIGS. 2, 3*a*, 3*b*, 4*a*, 4*b*, 5*a*, 5*b*, 6*a*, 6*b* and 7. This facilitates moulding of the first plurality of abutment surfaces. In addition, the outer skirt 11 is reinforced.

The lid 3 comprises an upper wall 12 and the first plurality of abutment projections 4 are formed integrally with the upper wall 12 of the lid 3, as seen in FIGS. 2, 3*a*, 3*b*, 4*a*, 4*b*, 5*b*, 6*a*, 6*b* and 7. This facilitates moulding of the first plurality of abutment surfaces.

The first plurality of abutment projections 4 are formed integrally with the upper wall 12 of the lid 3 and the outer skirt 11 of the lid 3, in particular in the upper circumferential corner 14 of the lid 3, see FIGS. 2, 3*a*, 3*b*, 4*a*, 4*b*, 5*b*, 6*a*, 6*b* and 7. This facilitates moulding of the first plurality of abutment surfaces further and improves the rigidity of the lid 3.

In the first embodiment visualised in FIGS. 1*a*, 1*b*, 2, 3*a*, 3*b*, 5*b*, 6*a*, 6*b* and 7 the lid 3 comprises a recessed area 9 in an upper surface of the lid 3, which recessed area 9 is outwardly, as seen from a centre of the lid 3 towards an outer skirt 11 of the lid 3 along a plane parallel to the upper surface of the lid 3, restrained by a restriction wall 10 located at a distance D from the outer skirt 11 of the lid 3, and the second plurality of abutment projections 7 are formed integrally with said restriction wall 10. This facilitates moulding of the second plurality of abutment surfaces, as well as reinforcement of the restriction wall 10. Each of the first and second plurality of abutment projections 4, 7 comprises in the first embodiment eleven abutment projections.

The recessed area 9 defines in the first embodiment together with the restriction wall 10 an additional storage compartment, e.g. for storing used tobacco. The additional storage compartment is covered by an additional lid 13, as seen in FIGS. 1*a* and 1*b*. The lid 3 is provided with a depression 22 in the circumference of the upper wall 12, thereby providing access to the rim of the additional lid 13. A user may thus open the additional lid 13 by locating his/her finger or the like in the depression 22 and exerting an opening force to the additional lid 13.

Figure 4A:
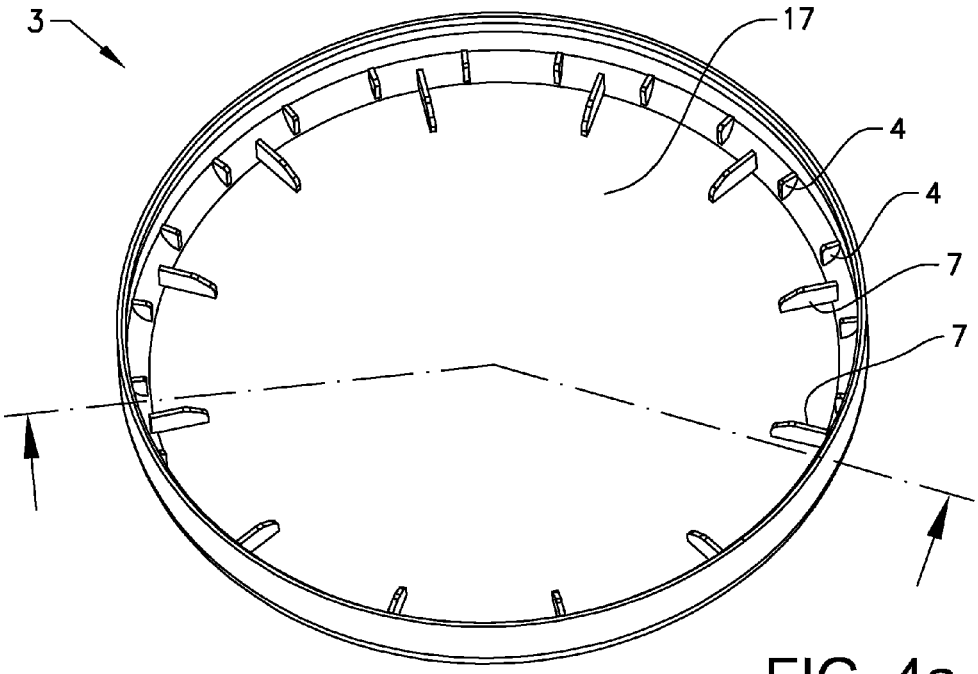
FIG. 4*a* is a perspective view of a second embodiment of a lid of a container according to the present disclosure turned upside down.
Figure 4B:
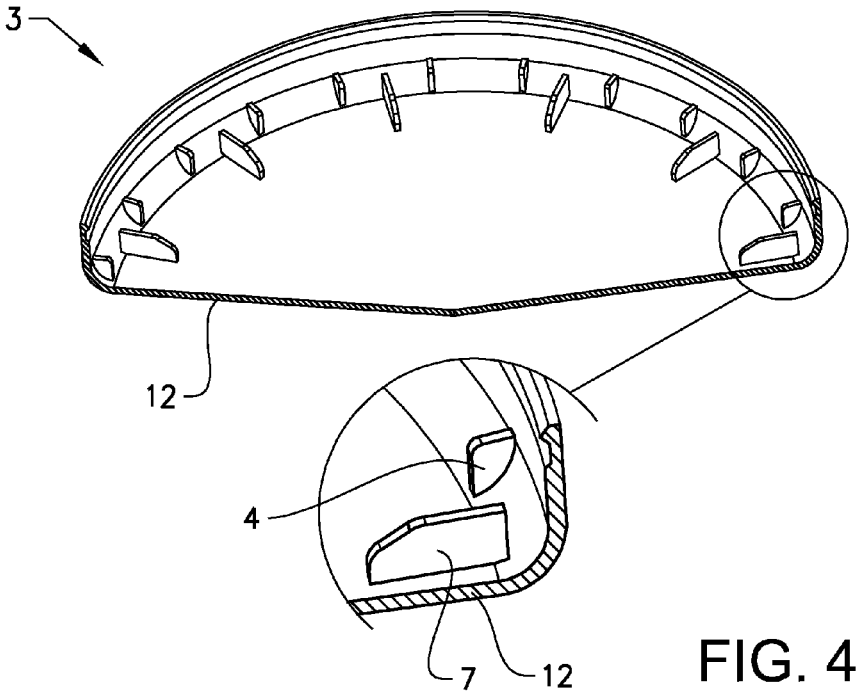
FIG. 4*b* is a perspective view of the lid in FIG. 4*a* having a cut-out and a magnified view of the region of projections.
Figure 5A:
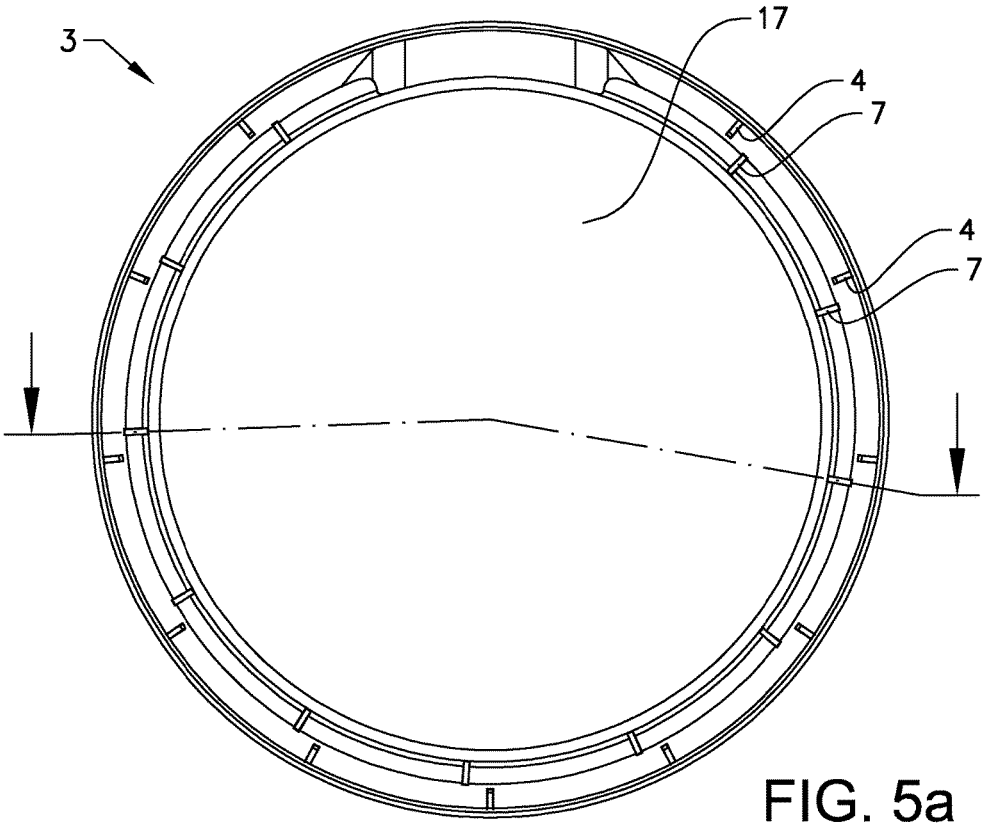
FIG. 5*a* is a bottom view of the lid in FIGS. 1*a*, 1*b*, 2, 3*a*, and 3*b*.

In a second embodiment of the disclosure as shown in FIGS. 4*a* and 4*b*, the lid 3 comprises an upper wall 12 which does not exhibit a recessed area 9 in the lid. The second plurality of abutment projections 7 are here formed integrally with the upper wall 12 of the lid 3. This facilitates moulding of the second plurality of abutment surfaces 7. The first plurality of abutment projections 4 comprises in the second embodiment 24 abutment projections, and the second plurality of abutment projections 7 comprises in the second embodiment 24 abutment projections.

In the first embodiment, the second plurality of abutment projections 7 are formed integrally with the upper wall 12 of the lid 3 and the restriction wall 10 of the lid 3. This facilitates moulding of the second plurality of abutment projections 7 and improves the rigidity of the lid 3

The second plurality of abutment projections 7 are offset in relation to the first plurality of abutment projections 4 in a circumferential direction of the lid 3.

This is visualised in FIGS. 3*a*, 3*b*, 4*a*, 4*b* and 5*a*. Thereby, each abutment projection of the second plurality of abutment projections 7 is located at a distance in the circumferential direction from the abutments projections of the first plurality of abutment projections 4. The second plurality of abutment projections 7 are also offset in relation to the first plurality of abutment projections 4 in an outward direction. Thus, the first plurality of abutment projections 4 do not interfere with the second plurality of abutment projections 7. The mouldability of the first and second plurality of abutment projections 4, 7 is thereby improved.

Alternatively, the second plurality of abutment projections 7 may extend at least as far outward, as seen from a centre of the lid towards an outer skirt 11 of the lid 3 along a plane parallel to an upper surface of the lid 3, as the inward extension, as seen from the outer skirt 11 of the lid 3 towards the centre of the lid 3 along a plane parallel to the upper surface of the lid 3, of the first plurality of abutment projections 4. In this embodiment, which is not shown in the figures, there is no gap between the first and second plurality of abutment projections in the outward/inward direction and thus the guiding of the abutment surface 5 of the base 2 from the second plurality of abutment projections to the first plurality of abutment projections is smooth and facilitated. Moreover, the risk that the skirt 15 of the lid may fall down between the first and second abutment projections 4, 7 is eliminated.

According to a yet further alternative, the second plurality of abutment projections 7 may extend outwardly, as seen from a centre of the lid 3 towards the outer skirt 11 of the lid 3 along a plane parallel to an upper surface of the lid 3, past the inward extension, as seen from the outer skirt 11 of the lid towards the centre of the lid 3 along a plane parallel to the upper surface of the lid 3, of the first plurality of abutment projections 4. In this embodiment, which is also not shown in the figures, the second plurality of abutment projections extends past the first plurality of abutment projections in the outward/inward direction leaving no gap between the first and second plurality of abutment projections in the outward/inward direction. Thus the guiding of the abutment surface 5 of the base 2 from the second plurality of abutment projections to the first plurality of abutment projections is yet smoother and further facilitated, and the risk that the skirt 15 of the lid may fall down between the first and second abutment projections 4, 7 is eliminated.

Figure 5B:
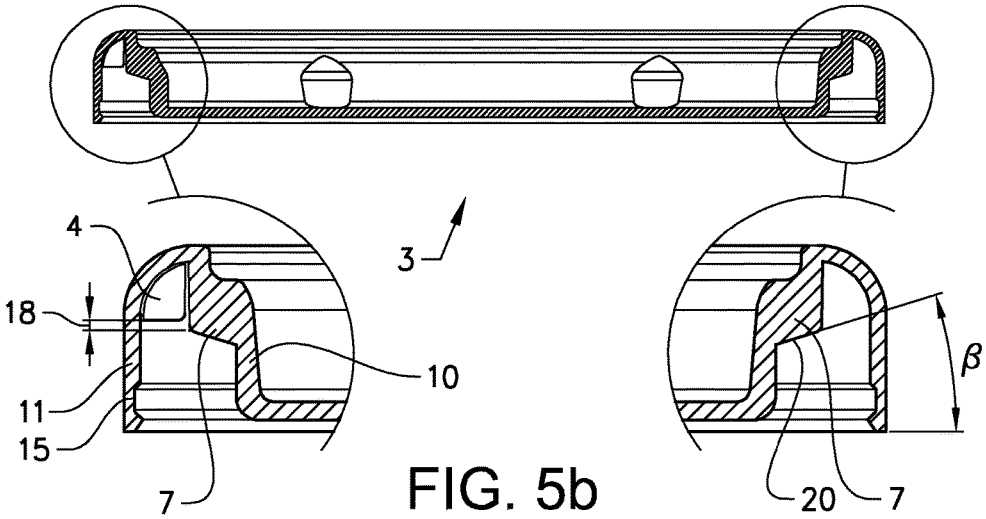
FIG. 5*b* is a cross-sectional side view of the lid in FIG. 5*a* along a section shown in FIG. 5*a* and having two magnified views of the region of projections.
Figure 6B:
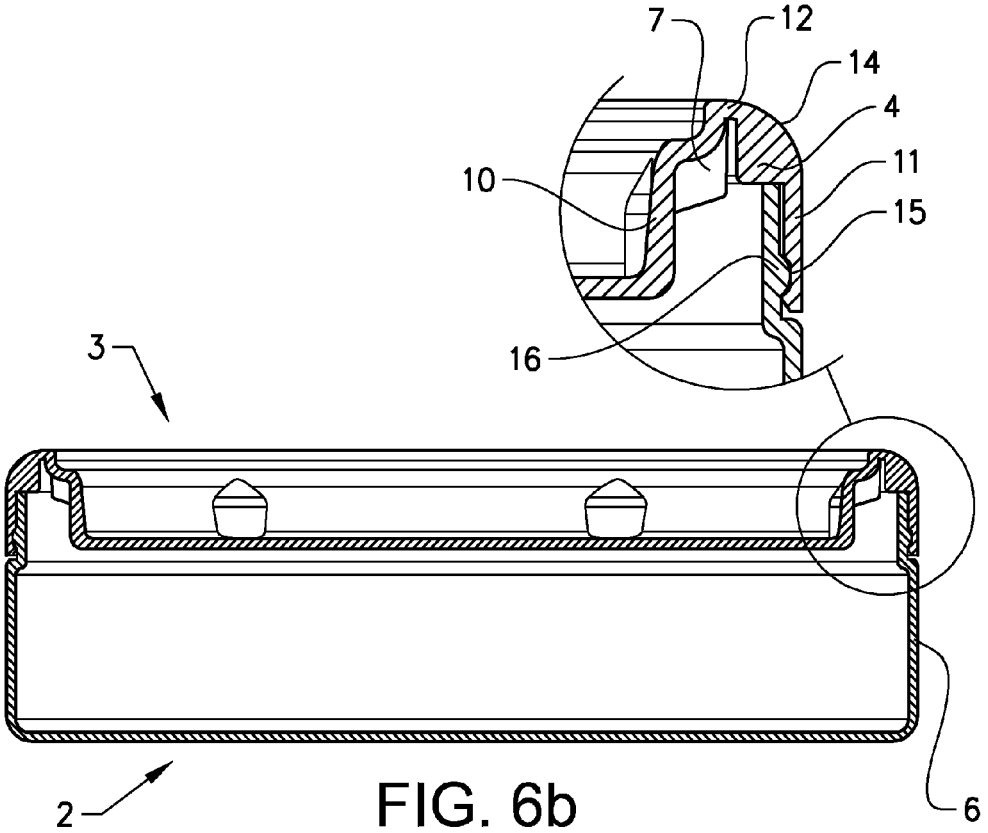
FIG. 6*b* is a side view of the container in FIG. 6*a*, where the container is closed and having a magnified view of the region of connection between the base and the lid.

The second plurality of abutment projections 7 extend past the downward extension of the first plurality of abutment projections 4 a distance 18 in a vertical direction, see FIG. 5*b*. Thus the guiding of the abutment surface 5 of the base 2 from the second plurality of abutment projections 7 to the first plurality of abutment projections 4 during pivoting closure of the lid 3 is smooth and simplified.

The first plurality of abutment projections 4 may be shaped as flat ribs that extend in an inward direction, as seen from the outer skirt 11 of the lid 3 towards the centre of the lid 3 perpendicular to the plane of the upper surface of the lid 3, as is shown in FIGS. 3*a*, 3*b*, 4*a*, 4*b* and 5*a*. Thereby, flat surfaces 19 acting as abutment surfaces are provided on the first plurality of abutment projections 4, which flat surfaces 19 facilitate abutment against the abutment surface 5 of the base 2.

The second plurality of abutment projections 7 are shaped as flat ribs that extend in an outward direction, as seen from a centre of the lid 3 towards an outer skirt 11 of the lid 3 perpendicular to the plane of the upper surface of the lid 3, as is shown in FIGS. 3*a*, 3*b*, 4*a*, 4*b* and 5*a*. Thereby, flat surfaces 20 acting as abutment surfaces are provided on the second plurality of abutment projections 7, which flat surfaces facilitate abutment against the abutment surface 5 of the base 2 in the inclined position of the lid. Also, the flat ribs facilitate the guiding of the abutment surface 5 of the base 2 from the second plurality of abutment projections 7 to the first plurality of abutment projections 4. The flat surface 20 of each of the second plurality of abutment projections 7 is preferably inclined with an angle β towards the plane of the lid 3 for improved contact with the abutment surface 5 of the base 2, as well as improved guidance of the abutment surface 5 of the base 2 to the first plurality of abutment projections 4.

Each flat rib of the first plurality of abutment projections 4 as well as each flat rib of the second plurality of abutment projections 7 is oriented parallel with a vertical plane, as is shown in FIG. 5*a*.

Figure 7:
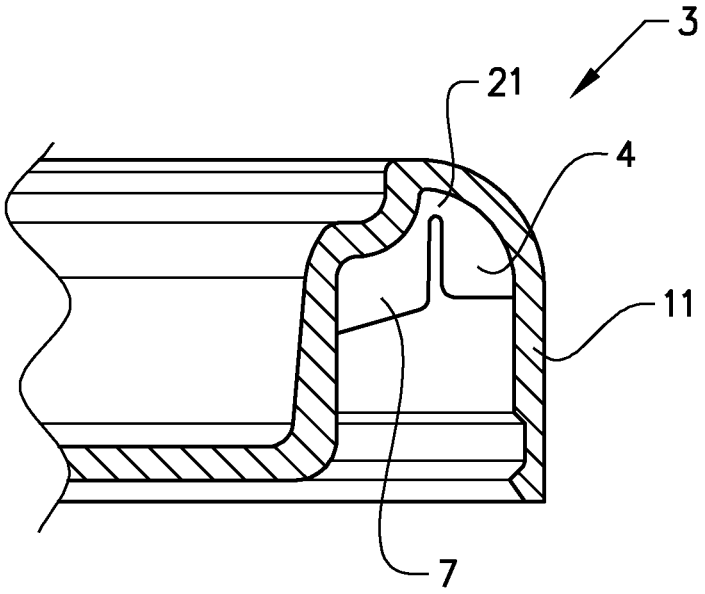
FIG. 7 is a side view of a projection of the first and second plurality of abutment projections, where the projections are integrally formed with a common base portion.

In an alternative embodiment shown in FIG. 7, it is shown that an abutment projection of the first plurality of abutment projections 4 may be formed having a common base 21 with a corresponding abutment projection of the second plurality of abutment projections 7, i.e. the abutment projections 4, 7 are connected to form a single member. The first and second plurality of abutment projections 4, 7 are here thus not offset in the circumferential direction.

The number of abutment projections of the first plurality of abutment projections is at least 6, preferably at least 8. In one embodiment, the number of abutment projections of the first plurality of abutment projections is 6-30, preferably 8-20. The number of abutment projections of the second plurality of abutment projections is at least 6, preferably at least 8. In one embodiment, the number of abutment projections of the second plurality of abutment projections is 6-30, preferably 8-20.

The upper circumferential corner 14 of the lid 3 is rounded, as seen in FIGS. 1*a*, 1*b*, 2, 3*b*, 5*b* 6*a* and 6*b*. The rounded corner of the lid enables improved comfort when carrying the container 1. Further, the rounded corner 14 may improve the aesthetic appearance of the container 1. The rounded upper circumferential corner has a radius of at least 1 millimeter, preferably at least 2 millimeters, more preferably at least 3 millimeters, and still more preferably at least 4 millimeters.

The outer skirt 11 of the lid 3 and/or the side wall 6 of the base 2 are resilient, and a lid coupling portion 15 located on the outer skirt 11 of the lid 3 is arranged to cooperate with a corresponding base coupling portion 16 located on the side wall 6 of the base 2 by snap action. This is shown in FIGS. 2, 6*a* and 6*b*. Thereby, the lid is easily affixed to the base and a securely closed container is obtained.

The lid 3 and the first and second pluralities of abutment projections 4, 7 are made of plastic material. In one embodiment, the base and the lid are made of plastic material. In one embodiment, the container is made of plastic material. By making a product of plastic material a durable product having suitable rigidity is obtained. Further, plastic material is rather cheap. Plastic material is also easy formable into a lid having first and second pluralities of abutment projections as well as a base. The plastic material may be a polymer. The lid 3 and the first and second pluralities of abutment projections 4, 7 are manufactured in one piece by moulding of plastic material. This is an easy and cost effective way of producing a lid having first and second pluralities of abutment projections.

Figure 8A:
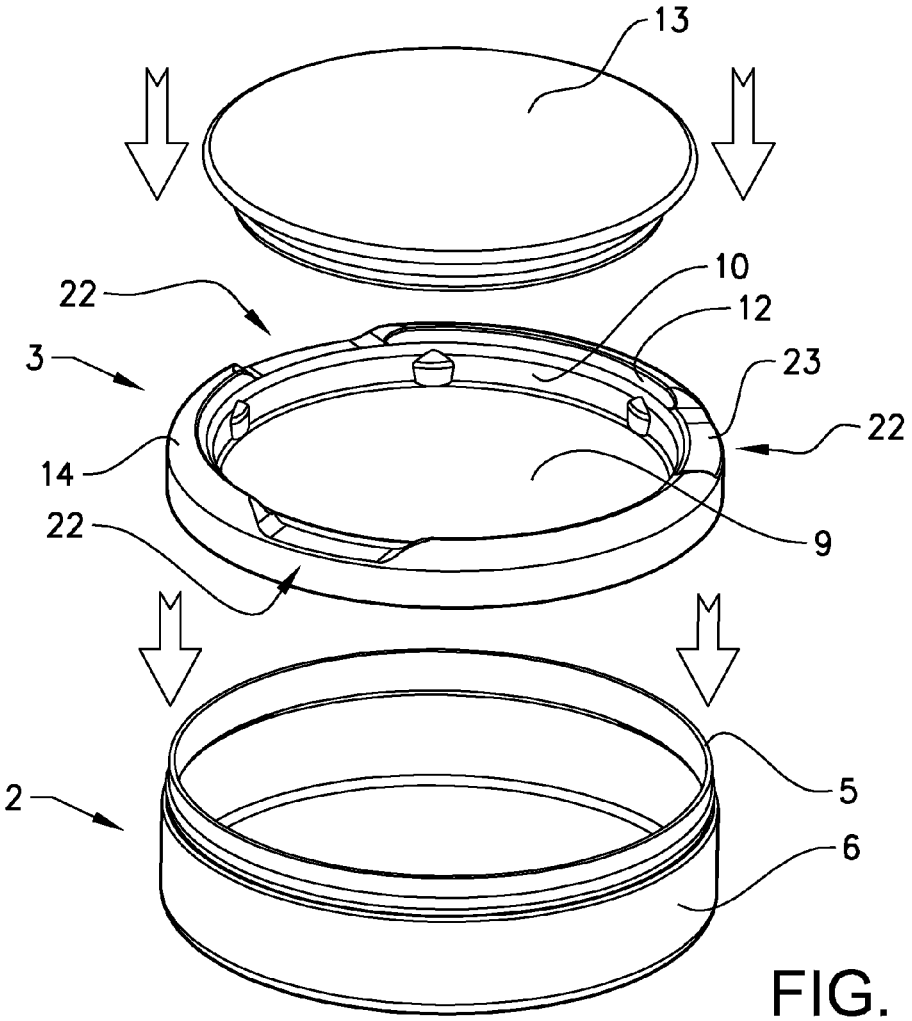
FIG. 8*a* is a perspective view of a third embodiment of a container according to the present disclosure having a base and a lid, where the container is open and the lid is placed at a distance from the base.
Figure 8B:
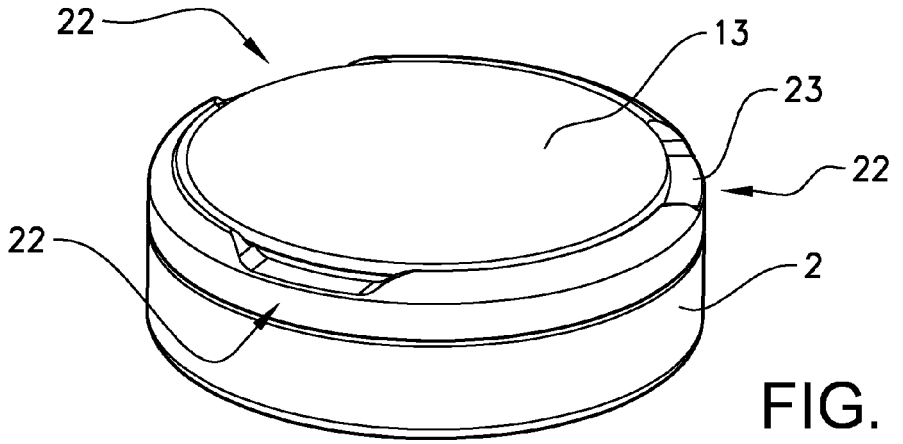
FIG. 8*b* is a perspective view of the container in FIG. 8*a*, where the container is closed.
Figure 9:
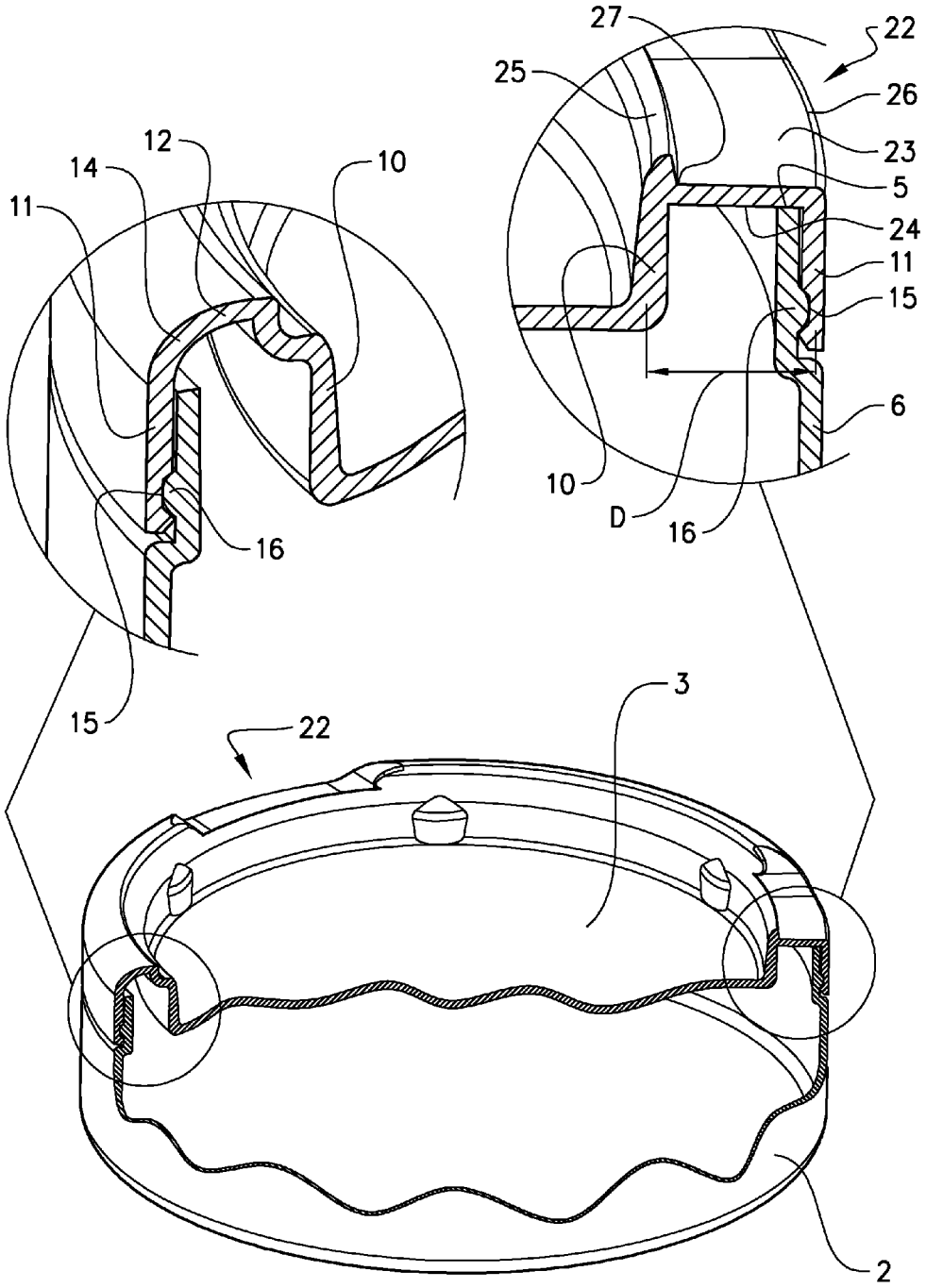
FIG. 9 is a perspective view of the container in FIGS. 8*a* and 8*b* having a cut-out and a magnified view of the region of connection between the base and the lid.
Figure 10A:
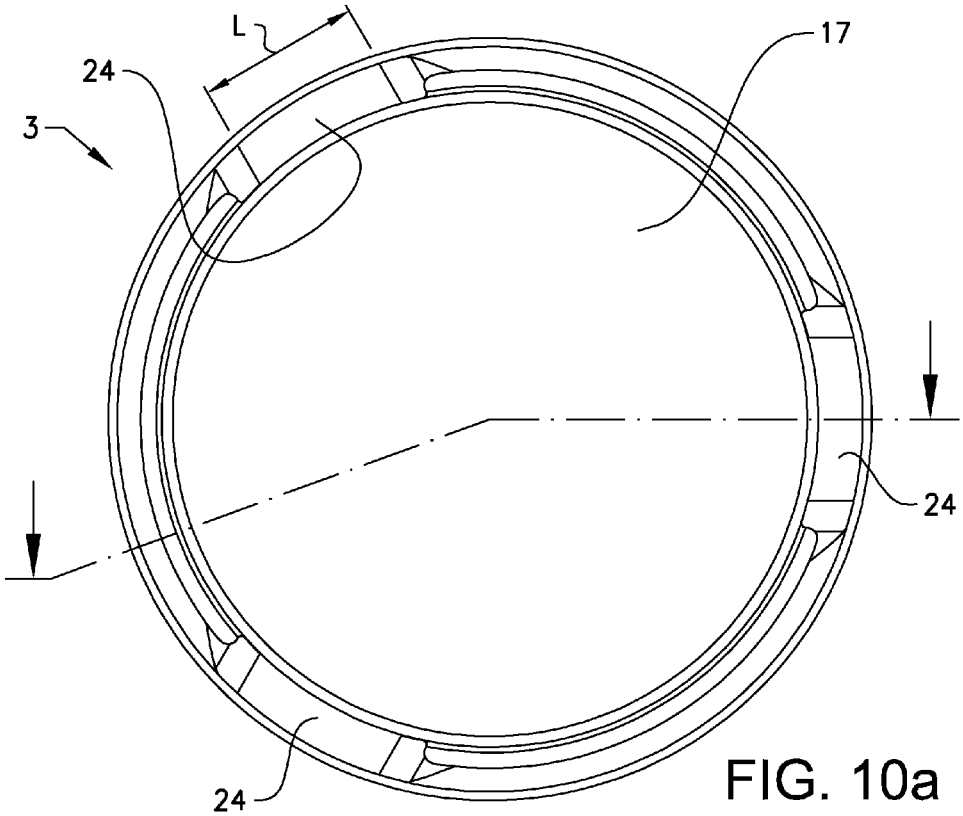
FIG. 10*a* is a bottom view of the lid in FIGS. 8*a*, 8*b* and 9.
Figure 10B:
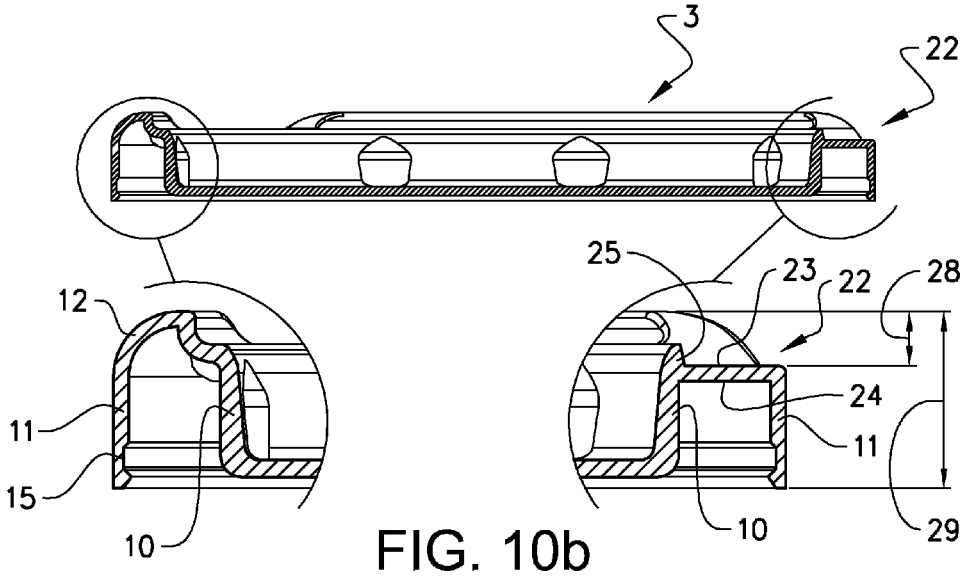
FIG. 10*b* is a cross-sectional side view of the lid in FIG. 10*a* along a section shown in FIG. 10*a* and having two magnified views of the region of projections.
Figure 11:
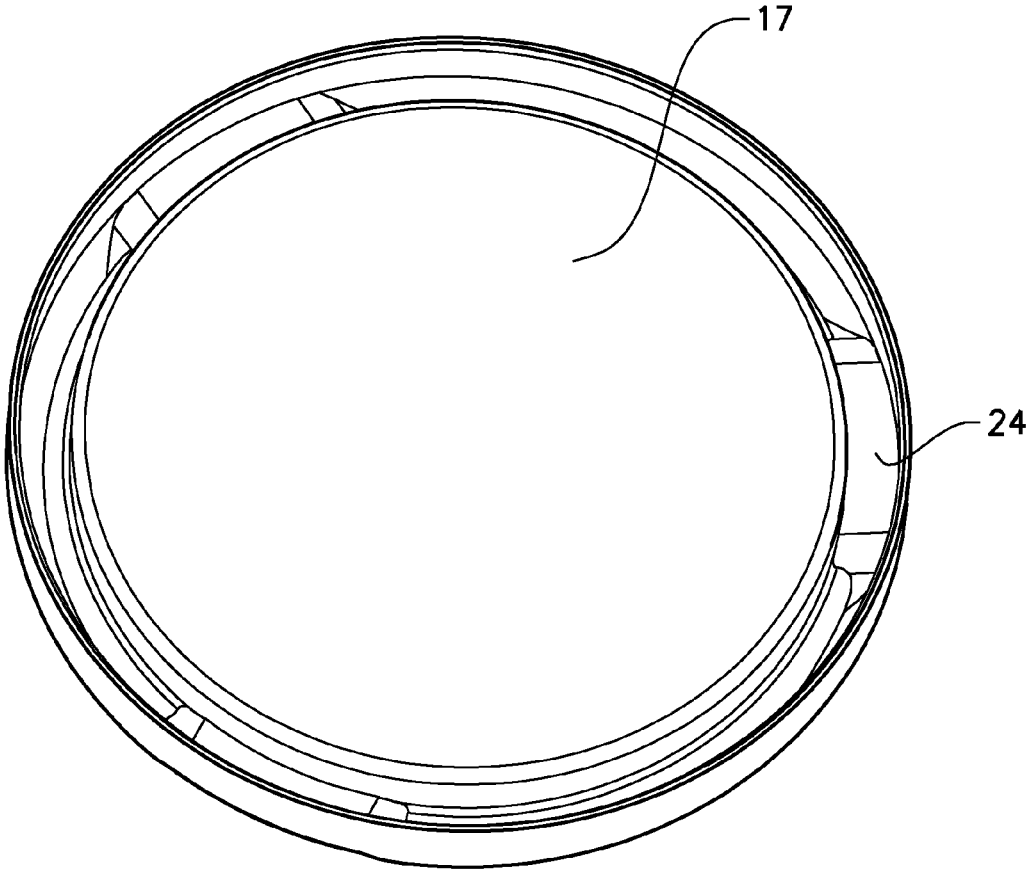
FIG. 11 is a perspective bottom view of the lid in FIGS. 8*a*, 8*b* and 9.

The present disclosure also relates to a third embodiment of the invention shown in FIGS. 8*a*, 8*b*, 9, 10*a*, 10*b* and 11. The container 1 of the third embodiment, having a base 2 and a lid 3, comprises three depressions 22 positioned circumferentially spaced apart along an upper wall 12 of the lid 3, i.e. the circumferential upper wall 12 is interrupted at three positions by depressions 22. A bottom 23 of each respective depression 22 extends along a plane substantially parallel to the upper surface of the lid 3. The depressions 22 are configured such that a respective downwardly facing surface 24 of each of the bottoms 23 is in contact with an upwardly facing abutment surface 5 of a side wall 6 of the base 2 when the base 2 and lid 3 are arranged parallel to each other and pressed together to form a closed container, or when the base 2 and lid 3 inclined with respect to each other and pressed together. As can be seen in FIG. 9 the downwardly facing surface 24 of the bottom 23 abuts the upwardly facing abutment surface 5 when the lid is properly fitted such that the container is closed. Such depressions 22, in which each bottom 23 extends along a plane parallel to the upper surface of the lid 3, facilitates proper abutment of the downwardly facing surface 24 and the abutment surface 5 even in containers having a rounded upper circumferential corner 14 of the upper wall 12.

The depressions are preferably evenly distributed along the circumference of the upper wall 12 of the lid 3.

The lid shown in 8*a*, 8*b*, 9, 10*a*, 10*b*, 11, 12*a*, 12*b*, 13 comprise a recessed area 9 as described in conjunction with FIGS. 1*a*, 2, 5*b*, 6*a*, 6*b* and 7. The additional storage compartment is covered by an additional lid 13, as seen in FIGS. 8*a* and 8*b*.

The depressions 22 extend, along a plane parallel to the upper surface of the lid 3, from the outer rim of the lid 3 in a direction towards the centre of the lid 3. The outer skirt 11 transitions into the bottom 23 of the depressions 22 along a first arc-shaped transition line 26. The plane of the bottom 23 is perpendicular to the main extension of the outer skirt 11. The bottom 23 of each depression 22 transitions along a second arc-shaped transition line 27 into the restriction wall 10. That is, the depressions 22 extend radially essentially over a distance D between the outer skirt 11 of the lid 3 along a plane parallel to the upper surface of the lid 3 to the restriction wall 10. Distance D is preferably 1-10 millimeters, more preferably 2-8 millimeters and still more preferably 2.5-6 millimeters.

An upwardly directed flange 25 is provided at the second transition line 27 between the restriction wall 10 and the upper surface of the bottom 23 of the depressions 22. The flange 25 is arranged to cooperate with the rim of the additional lid 13 such as to improve the sealing of the additional storage compartment.

At least one depression 22 has a length L in circumferential direction along the upper wall 12 of the lid 3 to an extent such that the rim of an additional lid 13 is accessible to a nail or finger for removal i.e. about 10-30 millimeters.

The depressions may have a height 28 measured from the bottom 23 of the depression to the top of the lid 3 of about 1-4 millimeters, preferably about 1.5-3 millimeters. In other terms, the ratio of the height 28 of the depressions 22 to the total height 29 of the lid 3 is preferably about ⅛-½, more preferably about ⅕-⅓.

The depressions 22 facilitate opening the additional storage compartment by allowing access to the rim of the additional lid 13 at the circumferential position of the depressions 22, as best seen in FIG. 8*b*.

The depressions 22 enable easy closing of the container 1 by downward pushing on top of the lid 3 also when the lid 3 is inclined in relation to the base 2. When the lid 3 is inclined in relation to the base 2 at least one of the depressions 22, extending between the outer skirt 11 and the restriction wall 10 of the lid 3, abuts the abutment surface 5 of the side wall 6 of the base 2 due to their even distribution along the circumference of the upper wall 12 of the lid 3. When pushing on the lid 3 the depression 22 guides the abutment surface 5 into a position where it is in contact with the outer part of the downwardly facing surface 24 as seen from the centre of the lid 3. This latter position is seen in FIG. 9*b*. The guiding of the abutment surface 5 of the base 2 accomplished by the depressions 22 is important during packaging of products, such as tobacco, into the container. If the lid 3 mounted on the base in an automatic assembly process performed by one or more machines, the lid may initially be positioned on the base inclined in relation to the base 2, either by purpose or by accident. Irrespective the underlying reason, the depressions 22 will upon actuation of a closing pressure on the lid guide the abutment surface 5 into a proper position enabling contact between the abutment surface 5 of the base 2 and depressions 22.

The depressions 22 are configured to contact the upwardly facing abutment surface 5 of a side wall 6 of the base 2 when the base 2 and the lid 3 are inclined at least in the range of 2 degrees-45 degrees in relation to each other. The distribution of several depressions 22 along the circumference of lid 3 ensure that the depressions 22 will facilitate correct closing of the container irrespective of the position of the lid 3 when the lid 3 is inclined in relation to the container prior to closing.

The depressions 22 are recessed in relation to the upper wall 12 of the lid 3 such that when a coupling portion 15 located on the outer skirt 11 of the lid 3 cooperates with a corresponding base coupling portion 16 located on the side wall 6 of the base 2 to snap lock the lid 3 to the container the downwardly facing surfaces 24 of the bottoms 23 of the depressions 22 are in contact with the upwardly facing abutment surfaces 5 of a side wall 6 of the base 2.

The features of FIGS. 8*a*, 8*b*, 9, 10*a*, 10*b* and 11 are in all other respects the same is explained in conjunction with the first embodiment as shown in FIGS. 1*a*-3*b* and 5*a*-6*b*.

By means of the depressions 22 a well-defined abutment surface of the lid in the closed state is provided, also for relatively large radius-lids, whilst it is avoided that the molten plastic flows to the outer surface of the outer skirt 11 of the lid 3 through different flow paths during manufacturing. Thereby, uneven colouring of the surface of an upper circumferential corner 14 of the lid 3 is avoided or at least reduced.

Figure 12A:
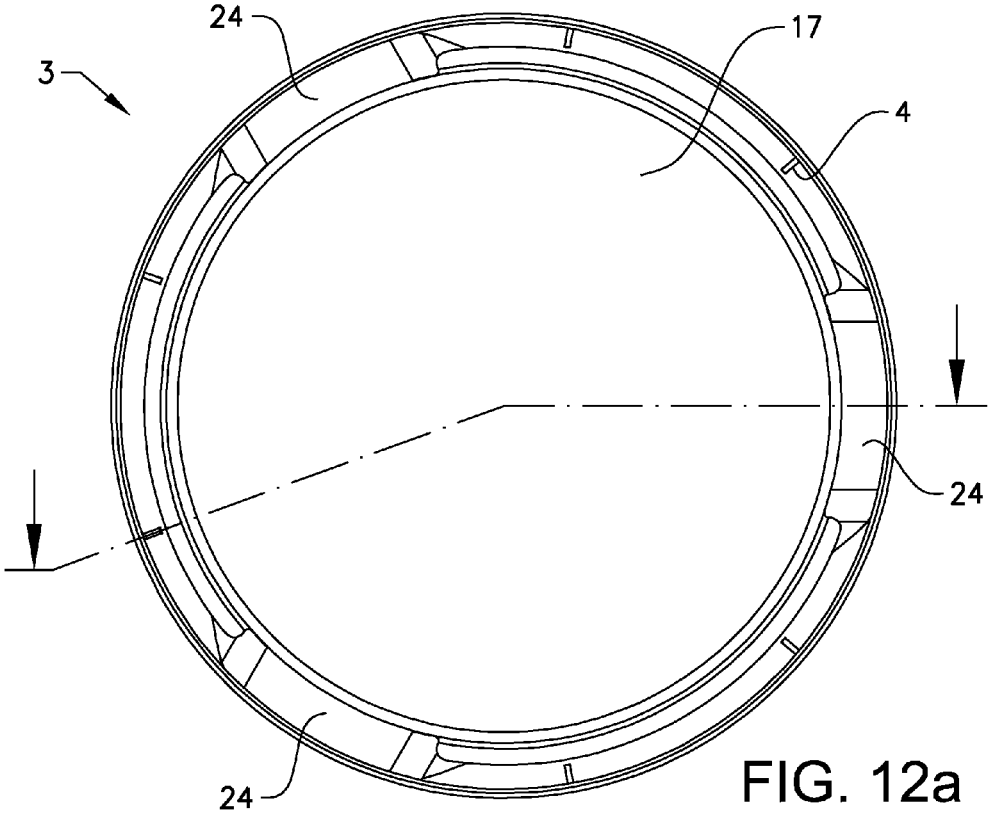
FIG. 12*a* is a bottom view of the lid of a fourth embodiment of a container according to the present disclosure.
Figure 12B:
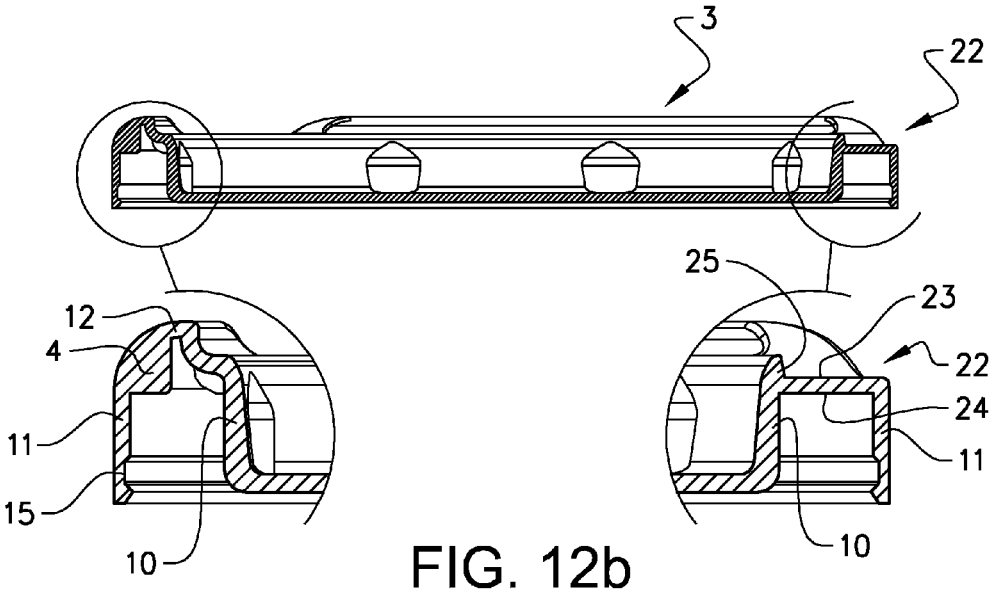
FIG. 12*b* is a cross-sectional side view of the lid in FIG. 12*a* along a section shown in FIG. 12*a* and having two magnified views of the region of projections.
Figure 13:
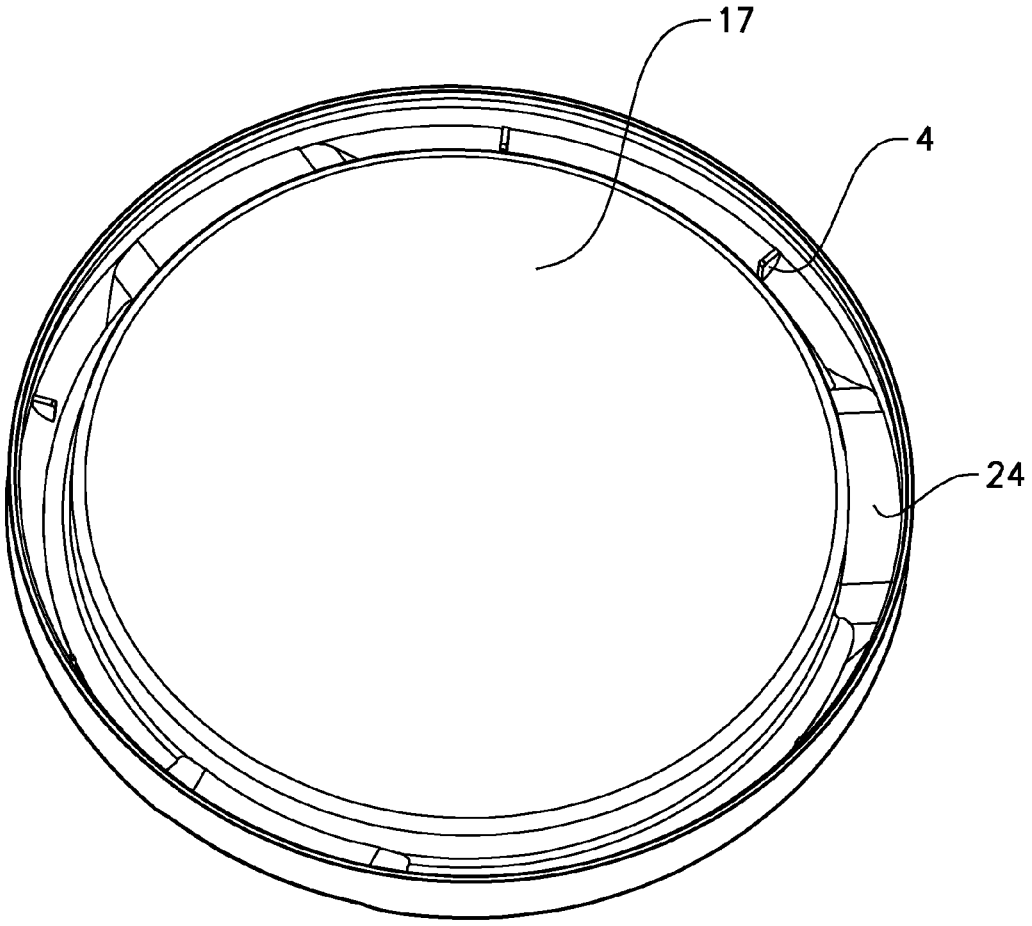
FIG. 13 is a perspective bottom view of the lid in FIGS. 12*a*, 12*b*.

The present disclosure also relates to a fourth embodiment of the invention shown in FIGS. 12*a*, 12*b* and 13. The lid 3 of the fourth embodiment comprises three depressions 22 as well as six abutment projections 4 positioned circumferentially spaced apart on an inside 17 of the lid 3, arranged in between the position of the three depressions 22. The first plurality of abutment projections 4 are configured to contact an upwardly facing abutment surface 5 of a side wall 6 of the base 2 when the base 2 and lid 3 are arranged parallel to each other and pressed together to form a closed container 1.

The features of FIG. 12-13 are in all other respects the same as explained in conjunction with the embodiments of FIGS. 1*a*-11.

The invention also encompasses an embodiment (not shown) in which the lid 3 comprises circumferentially spaced depressions 22 as well as first and second pluralities of abutment projections 4, 7 arranged between the depressions 22. In such an embodiment the second plurality of abutment projections 7 are positioned circumferentially spaced apart on an inside of the lid, evenly distributed between the positions of the depressions 22, and configured to contact an upwardly facing abutment surface 5 of a side wall 6 of the base 2 when the base 2 and the lid 3 are arranged inclined to each other and pressed together. The second plurality of abutment projections 7 thereby facilitate proper application of the lid 3 at an inclined angle if the lid 3 is positioned such that a portion of the second plurality of abutment projections 7 rather than one of the depressions 22 are brought in initial contact with the abutment surface 5 of the base 2 when applying the lid 3 at an inclination in relation to the base i.e. at an angle. This is also shown and explained in conjunction with FIG. 6*a*.

A lid 3 with first and second pluralities of abutment projections 4, 7, with depressions 22 or with a combination of projections 4, 7 and depressions 22 allows for proper application of a lid 3 also at an angle in relation to the base 2. The invention is especially useful for lids 3 with a rounded upper circumferential corner 14 which would, if no abutment ribs were present, not provide a suitable abutment surface against the base 2. In addition, the previously existing problem of uneven colouring (of lids comprising radially extending continuous ribs) due to uncontrolled flow paths during manufacturing of the lid 3 through moulding is avoided or at least reduced. In all embodiments described herein the flow path for the molten plastic during moulding is limited and thus counteracting flow paths causing uneven colouring are avoided.

The third and fourth embodiments have been disclosed having three depressions 22. However, the number of depressions 22 may be two or more than three, for example four, five, six, seven. Similarly, the depressions 22 are preferably evenly distributed around the circumference but the depressions 22 may alternatively be unevenly distributed. Also, the size, form and shape of the all depressions 22 of the lid are preferably identical but one or more of the depressions 22 may alternatively exhibit a different size, shape and form compared with the other depressions 22. When only two depressions are provided in the lid these depression may have a relatively large length L to compensate for the inherent lack of stability in a design having only two support locations, in particular in designs lacking abutment projections 4.

The shape of the container, as seen from top of the container, is circular but also other, non-showed shapes, are encompassed in the scope disclosure, such as for example elliptic, rectangular or quadratic. In case of rectangular or quadratic shape of the container, the corners of the quadratic shape may be rounded. Preferably, the container is circular. The base and the lid have the same shape as the container as seen from top of the base, lid and container, respectively. Circular containers having circular lid and circular base are visualised in FIGS. 1*a*, 1*b*, 2, 3*a*, 3*b*, 4*a*, 4*b*, 5*a*, 5*b*, 6*a*, 6*b* 8*a*, 8*b*, 9, 10*a*, 10*b*, 11, 12*a*, 12*b* and 13.

When the container is circular, the abutment projections of both the first and second plurality of abutment projections 4, 7 extend in a radial direction, as seen in FIG. 5*a*.

The maximum dimension of the container is preferably in the range of 40 mm-130 mm, and more preferably 50 mm-120 mm.

When the container is circular, the diameter of the container is in the range of 30 mm-90 mm, preferably 40 mm-80 mm.

The height of the container is in the range of 10 mm-30 mm, preferably 15 mm-25 mm.

All directions and orientations used herein are defined when the container stands on a horizontal surface, wherein the base of the container stands on the horizontal surface and the lid is arranged above the base. Consequently, lower means closer to the horizontal surface and upper means more far away from the horizontal surface in a vertical direction perpendicular to the horizontal surface.

Inward means horizontally from a point at the outer skirt of the container towards the centre of the container. Similarly, outward means horizontally from the centre of the container towards a point at the outer skirt of the container.

Circumferentially means along a path that in each point is parallel to the outer skirt of the container. In case of a circular container, circumferentially implies annularly.

Vertical means perpendicular to the horizontal plane. A vertical plane means a plane perpendicular to the horizontal surface.

In case of a circular container, a radial direction means a direction along the radius of the circular container.

Reference signs mentioned in the claims should not be seen as limiting the extent of the matter protected by the claims, and their sole function is to make claims easier to understand.

As will be realised, the disclosure is capable of modification in various obvious respects, all without departing from the scope of the appended claims. Accordingly, the drawings and the description thereto are to be regarded as illustrative in nature, and not restrictive.

The invention claimed is:

1. A container comprising a base; and a lid, wherein the lid comprises a first plurality of abutment projections spaced apart circumferentially on an inside surface of the lid configured to contact an upwardly facing abutment surface of a side wall of the base when the base and the lid are arranged parallel to each other and pressed together to form a closed container, and wherein the lid further comprises a second plurality of abutment projections spaced apart circumferentially on an inside surface of the lid and configured to contact an upwardly facing abutment of the side wall of the base when the base and the lid are arranged inclined to each other and pressed together.

2. The container according to claim 1, wherein the second plurality of abutment projections is configured to contact the upwardly facing abutment surface of the side wall of the base when the base and the lid are inclined in the range of 2 degrees to 45 degrees in relation to each other.

3. The container according to claim 1, wherein the second plurality of abutment projections is configured to contact the upwardly facing abutment surface of the side wall of the base when the base and the lid are inclined in the range of 5 degrees to 40 degrees in relation to each other.

4. The container according to claim 1, wherein the second plurality of abutment projections is configured to contact the upwardly facing abutment surface of the side wall of the base when the base and the lid are inclined in the range of 10 degrees to 35 degrees in relation to each other.

5. The container according to claim 1, wherein the lid further comprises an outer skirt configured to enclose an upper portion of the side wall of the base when the base and the lid are pressed together to form a closed container.

6. The container according to claim 5, wherein the first plurality of abutment projections is formed integrally with the outer skirt of the lid.

7. The container according to claim 1, wherein the lid further comprises a recessed area in an upper surface of the lid that is surrounded by a restriction wall, and wherein the second plurality of abutment projections are formed integrally with the restriction wall.

8. The container according to claim 1, wherein the lid further comprises an upper wall, and wherein the second plurality of abutment projections are formed integrally with the upper wall.

9. The container according to claim 1, wherein the second plurality of abutment projections are offset in relation to the first plurality of abutment projections in a circumferential direction of the lid.

10. The container according to claim 1, wherein the second plurality of abutment projections are positioned outward from the center of the inside surface of the lid such that the outward ends of the abutment projections extend at least as far outward as the inward ends of the first plurality of abutment projections.

11. The container according to claim 10, wherein the second plurality of abutment projections are positioned circumferentially from the center of the inside surface of the lid such that the outward ends of the second plurality of abutment projections extend past the inward ends of the first plurality of abutment projections.

12. The container according to claim 1, wherein the first plurality of abutment projections are shaped as flat ribs that extend towards the center of the lid along a plane parallel to an upper surface of the lid.

13. The container according to claim 1, wherein the second plurality of abutment projections are shaped as flat ribs that extend towards an outer skirt of the lid along a plane parallel to an upper surface of the lid.

14. The container according to claim 1, wherein the upper circumferential corner of the lid is rounded, and the first plurality of abutment projections are formed integrally with the inside of the rounded corner of the lid.

15. The container according to claim 1, wherein one or both of an outer skirt of the lid and the side wall of the base is resilient, and a lid coupling portion located on the outer skirt of the lid is arranged to cooperate with a corresponding base coupling portion located on the side wall of the base by snap action.

16. The container according to claim 1, wherein the lid and the first and second pluralities of abutment projections are manufactured in one piece by molding of plastic material.

17. The container according to claim 1, wherein the lid additionally comprises an upper wall and at least two depressions spaced apart along the circumference of the upper wall, wherein the depressions are configured such that a downwardly facing surface of a bottom of the depressions contacts an upwardly facing abutment surface of the side wall of the base when the base and lid are pressed together to form a closed container.

* * * * *